US008082901B2

(12) United States Patent
Zhuang et al.

(10) Patent No.: US 8,082,901 B2
(45) Date of Patent: Dec. 27, 2011

(54) DIESEL ENGINE

(75) Inventors: Hualiang Zhuang, Changzhou (CN); Ronghua Yang, Changzhou (CN); Ke'ai Qiu, Changzhou (CN); Weilin Dai, Changzhou (CN)

(73) Assignee: Changchai Co., Ltd, Changzhou, Jiangsu (CN)

( * ) Notice: Subject to any disclaimer, the term of this patent is extended or adjusted under 35 U.S.C. 154(b) by 292 days.

(21) Appl. No.: 12/577,302

(22) Filed: Oct. 12, 2009

(65) Prior Publication Data

US 2010/0170457 A1 Jul. 8, 2010

(30) Foreign Application Priority Data

Jan. 6, 2009 (CN) ..... 2009 2 0000178 U

(51) Int. Cl.
*F02D 41/00* (2006.01)
*F02D 41/02* (2006.01)

(52) U.S. Cl. ..... 123/357; 123/54.4

(58) Field of Classification Search ..... 123/357, 123/54.4, 184.31, 510, 364, 195 R
See application file for complete search history.

(56) References Cited

U.S. PATENT DOCUMENTS

| | | | | |
|---|---|---|---|---|
| 1,955,799 | A | | 4/1934 | Fielden |
| 2,099,852 | A | | 11/1937 | Knudsen |
| 2,796,057 | A | | 6/1957 | Dolza |
| 2,821,969 | A | | 2/1958 | Scheiterlein |
| 4,054,108 | A | | 10/1977 | Gill |
| 4,058,092 | A | | 11/1977 | Hikosaka |
| 4,412,513 | A | | 11/1983 | Obermayer |
| 4,862,981 | A | | 9/1989 | Fujikawa |
| 5,479,903 | A | | 1/1996 | Werner |
| 5,564,395 | A | | 10/1996 | Moser |
| 5,617,826 | A | * | 4/1997 | Brandt ..... 123/450 |
| 5,992,393 | A | | 11/1999 | Yoshida |
| 6,357,401 | B1 | | 3/2002 | Moriyama |
| 6,669,453 | B1 | | 12/2003 | Breeden |
| 6,941,914 | B2 | | 9/2005 | Snyder |
| 7,162,985 | B2 | | 1/2007 | Itoh |

FOREIGN PATENT DOCUMENTS

| | | |
|---|---|---|
| DE | 966708 | 9/1957 |
| JP | 53059132 | 5/1978 |
| JP | 58006048 | 2/1983 |
| JP | 2188627 | 7/1990 |
| JP | 6200782 | 7/1994 |
| JP | 6299862 | 10/1994 |

* cited by examiner

*Primary Examiner* — Mahmoud Gimie
(74) *Attorney, Agent, or Firm* — Michael Haynes PLC; Michael N. Haynes

(57) ABSTRACT

Exemplary embodiments can provide at least one of a system, machine, device, and manufacture that can comprise: a V-type water-cooled diesel engine comprising: a first cylinder and a second cylinder disposed in a V-shape; a plurality of injection pumps adapted to serve each respective cylinder; and a fuel governor adapted to control fuel from the injection pumps, the fuel governor disposed between the cylinders; wherein the governor is an electrical governor and disposed outside a crankcase that is located between the cylinders, and the plurality of injection pumps are mounted on a cover of the crankcase.

10 Claims, 4 Drawing Sheets

DIESEL ENGINE

CROSS-REFERENCES TO RELATED APPLICATIONS

This application claims priority to China Patent Application 200920000178.0, filed 6 Jan. 2009.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
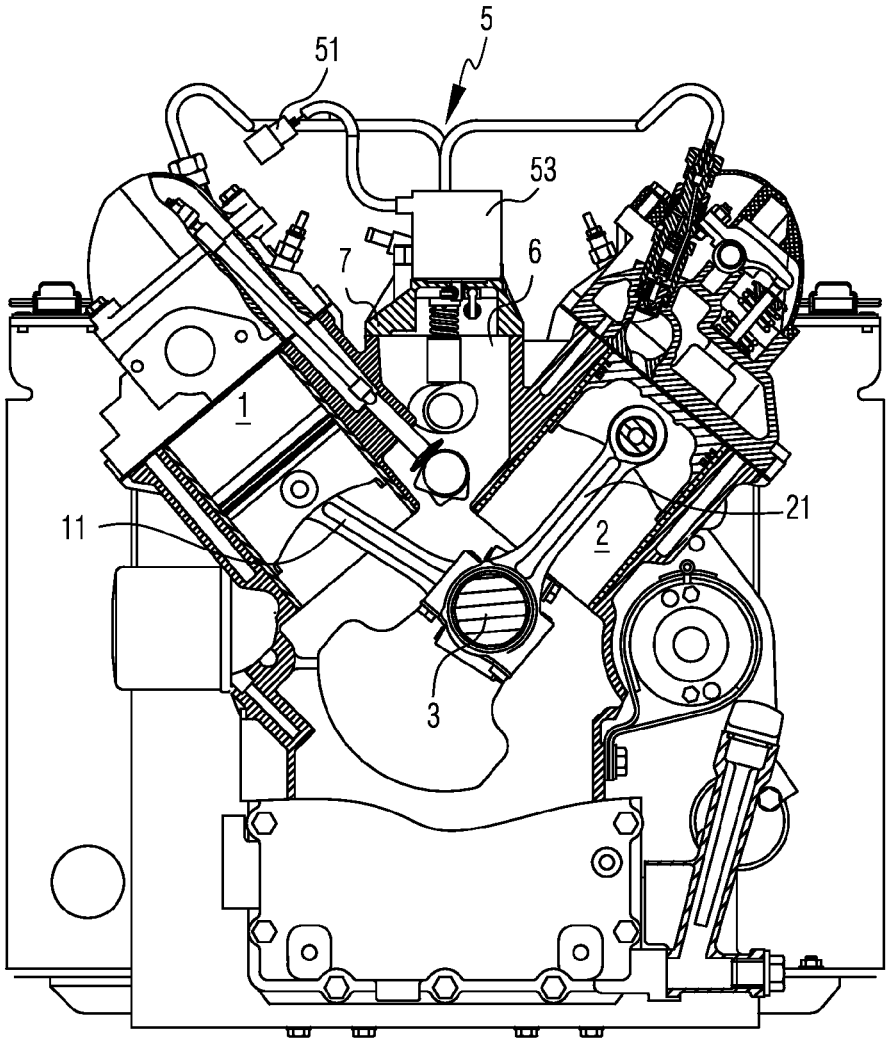
FIG. 1 is a cross sectional view of an exemplary V-type water-cooled diesel engine.

Certain exemplary embodiments can provide a small and compact V-type water-cooled diesel engine.

Certain exemplary embodiments can provide a V-type water-cooled diesel engine having a left cylinder and a right cylinder disposed in a V shape. Injection pumps and a governor, which can control fuel from the injection pumps, can be disposed between the cylinders. The governor can be an electrical governor disposed outside a crankcase, which can be located between the cylinders. The injection pumps of the cylinders can be mounted on the crankcase cover.

Certain exemplary embodiments can provide a V-type water-cooled diesel engine in which the injection pumps of the cylinders controlled by one fuel governor mechanism. The electrical governor can control the opening of the fuel injection pumps of the cylinders by the fuel governor mechanism.

Certain exemplary embodiments can provide a V-type water-cooled diesel engine in which the fuel governor mechanism comprises an arm connected with opening of the injection pumps the cylinders.

Certain exemplary embodiments can provide a V-type water-cooled diesel engine in which the fuel governor mechanism comprises a spring, which can make the opening of the injection pumps bias to their closed and/or lowest fuel pumping position.

Certain exemplary embodiments can provide a V-type water-cooled diesel engine in which the fuel governor mechanism further comprises an adjustment unit connecting with the spring. The adjustment unit can have an end connecting the motor shaft of the electrical governor and the other end connecting the arm.

Certain exemplary embodiments can provide a V-type water-cooled diesel engine in which the adjustment unit comprises a rocker arm with its one end fixing the motor shaft, a pulling rod, and a ball stud. The other end of the rocker-arm can be rotationally engaged to the pulling rod via the ball stud. The other end of the pulling rod can be rotationally engaged to the arm.

Certain exemplary embodiments can provide a V-type water-cooled diesel engine in which the ball head of the ball stud can move in a groove of the rocker-arm and the other end of the ball stud can be attached on the pulling rod. The groove can have an open end.

Certain exemplary embodiments can provide a V-type water-cooled diesel engine in which the spring can be biased to the pulling rod and keep the feed ports of the pumps open at their closed and/or lowest fuel pumping position.

Certain exemplary embodiments can provide a V-type water-cooled diesel engine in which the pulling rod can be provided in a locating sleeve and can have a stop structure which prevents the pulling rod from rotating, thereby limiting its travel.

Accordingly, the fuel injection pumps and small sized electrical governor can be constructed on the crankcase cover, which can compact the crankcase cover of the V-type water-cooled diesel engine.

Furthermore, the electrical governor can control the injection pumps spontaneously via the governor mechanism since the injection pumps can share the same fuel governor mechanism.

Also, the feed ports of the injection pumps can be maintained in their closed and/or lowest fuel pumping and/or transmission position by the spring, which can ensure the safety of the engine.

Various embodiments of the V-type water-cooled diesel engine are now described with reference to the figures, where like reference numbers indicate identical or functionally similar elements. As used herein, the term "a" means "one or more than one".

Figure 2:
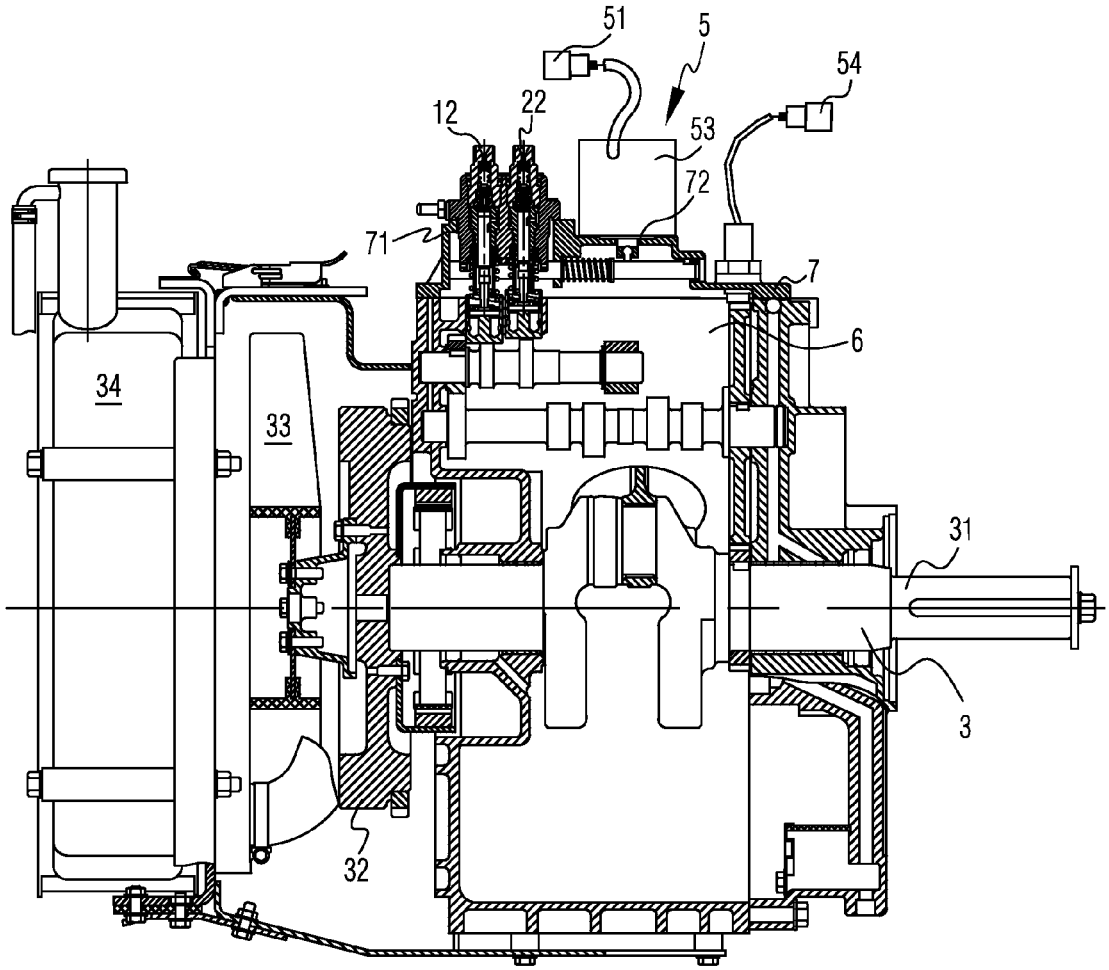
FIG. 2 is a longitudinal sectional view of the V-type water-cooled diesel engine of FIG. 1.
Figure 3:
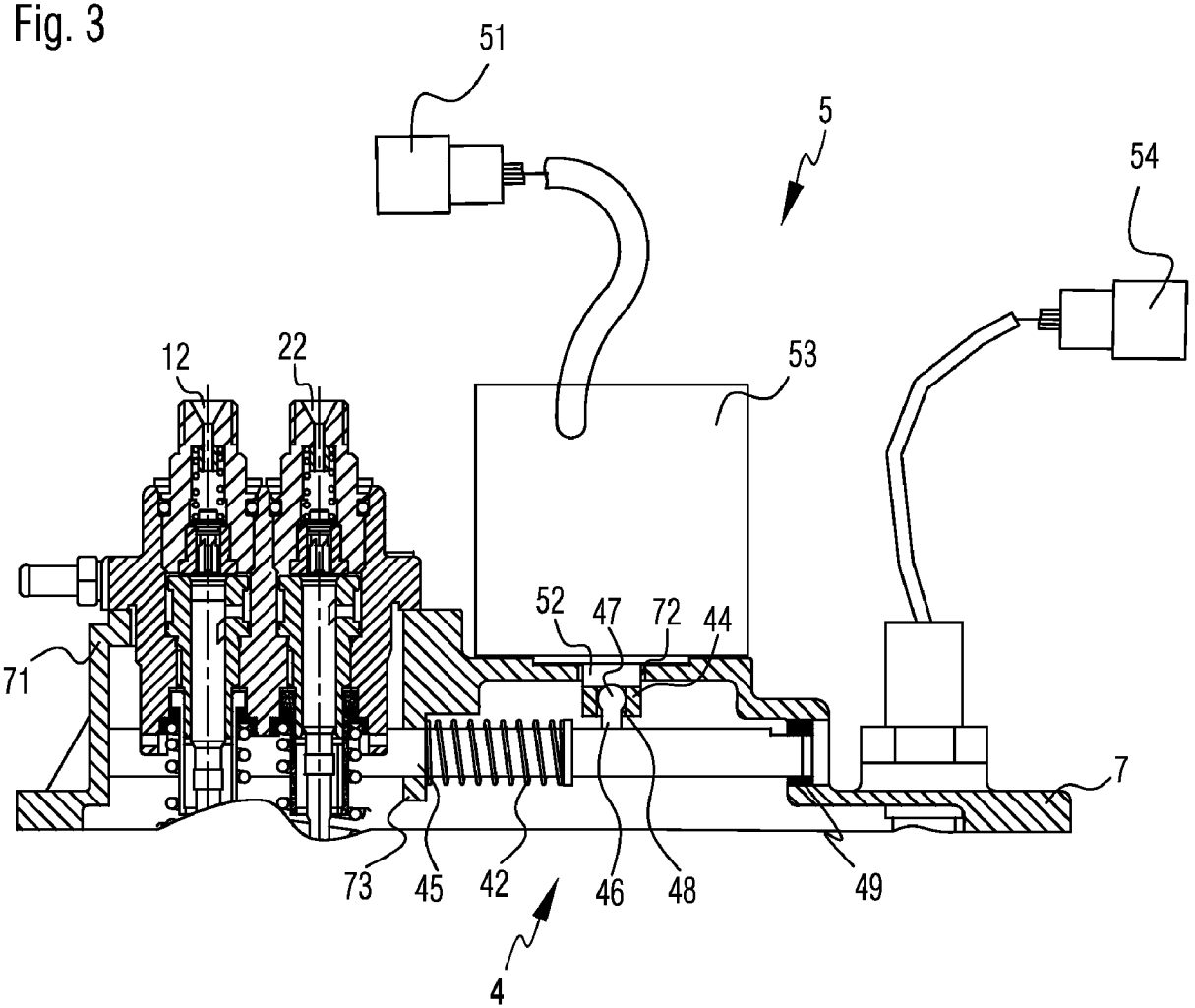
FIG. 3 is an enlarged partial view of FIG. 2 which shows the structure of fuel governor mechanism.

FIGS. 1 to 3 show an exemplary embodiment of a V-type water-cooled diesel engine. Referring to FIG. 1, the engine includes a left cylinder 1 and a right cylinder 2 disposed in a V shape. Pistons in the left cylinder 1 and the right cylinder 2 are connected to a crankshaft 3 by connecting rods 11 and 21 respectively.

As shown in FIG. 2, the crankshaft 3 can rotate in the crankcase via connecting rods 11 and 21 when the pistons reciprocate in left cylinder 1 and right cylinder 2 respectively, thus power can be output through the outputting end 31 of the crankshaft 3. A starting flywheel 32, a cooling fan 33, and a water tank 34 are disposed in sequence along the longitudinal axis of crankshaft 3 on the opposite side of the outputting end 31 of the crankshaft 3.

As shown in FIG. 2, injection pump 12 of left cylinder 1, injection pump 22 of right cylinder 2, and electrical governor 5 are arranged between left cylinder 1 and right cylinder 2. To accommodate these parts, an open region 6 can be constructed on the crankcase with a crankcase cover 7 between the V shaped cylinders. The injection pumps 12 and 22 are disposed on the crankcase cover 7 and extended into the inside of the crankcase by a pump supporter 71 on the crankcase 7. The electrical governor 5 can be disposed outside of the crankcase cover 7.

Referring to FIGS. 2 and 3, the electrical governor 5 comprises a control unit 51, a stepper motor 53 and a speed sensor 54. The control unit 51 can control the movement of stepper motor 53 according to the crankshaft rotational speed signal as detected by the revolution speed sensor 54. The stepper motor 53 is fixed outside the crankcase cover 7. A motor shaft 52 is extended into the open region 6 of the crankcase through a hole 72 in the crankcase cover 7.

Figure 4:
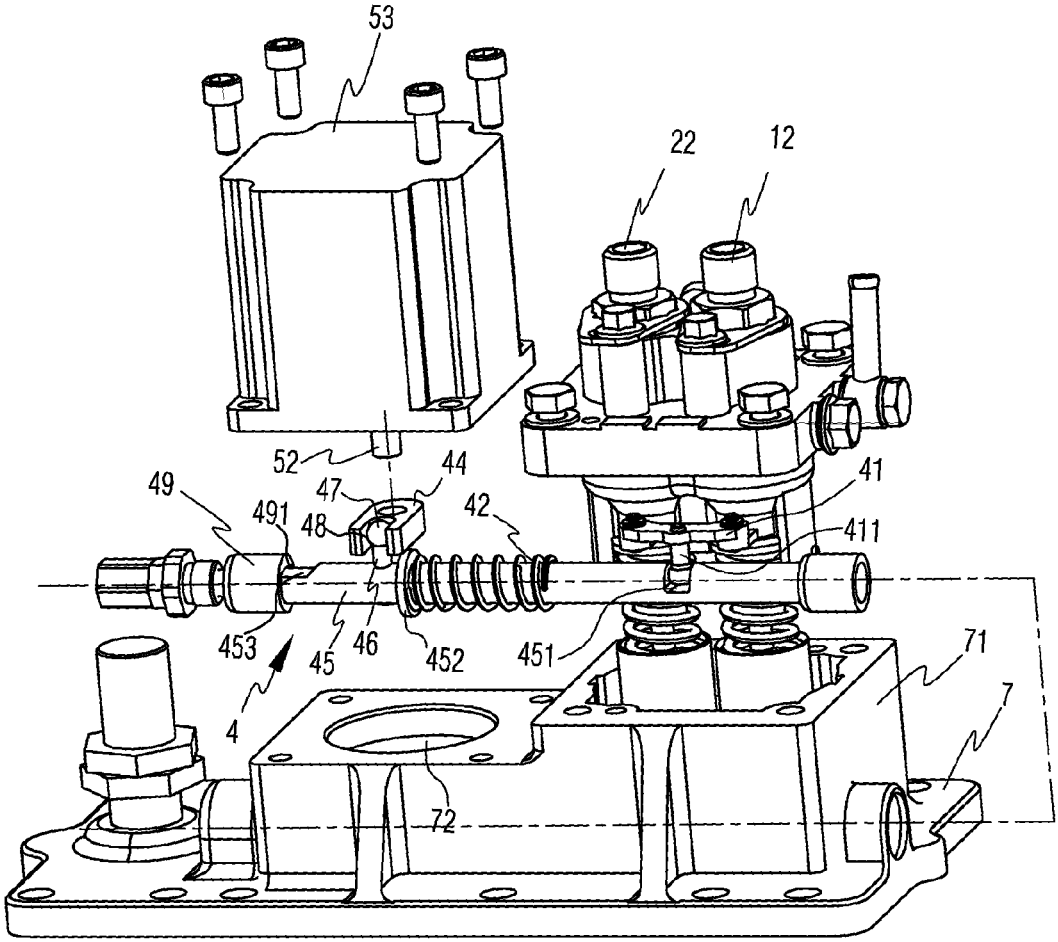
FIG. 4 is a perspective view of a fuel governor mechanism of another exemplary V-type water-cooled diesel engine.

As shown in FIG. 4, the injection pumps 12 and 22 share one fuel governor mechanism including a fuel governor arm 41 connecting with the feed ports of the injection pump 12 and 22, a spring 42 and a governor unit 4 connecting the spring 42. The fuel governor arm 41 is yoke-shaped and has two branch arms with their free ends respectively connecting the feed ports of the injection pumps 12 and 22. The joint of the branch arms can be rotationally engaged to one end of the governor unit 4 by a rotate shaft 411. The other end of the governor unit 4 connects with the motor shaft 52 of the stepper motor 53, which extends into the crankcase.

The motor shaft 52 moves the fuel governor arm 41 by the governor unit 4 when the stepper motor 53 in operation. Then the fuel governor arm 41 controls the opening size of the feed ports of the connecting injection pump 12 and 22. The governor unit 4 is retained in certain side by the spring 42 connecting so that the feed ports of the injection pumps 12 and 22 can be maintained in their closed and/or lowest fuel pumping and/or transmission position.

The fuel governor arm 41, spring 42 and governor unit 4 of fuel governor mechanism are shown in FIG. 4. The governor unit 4 comprises a rocker-arm 44, a pulling rod 45, and a ball stud 46. The rocker-arm 44 has one end fixed on the motor shaft 52 and the other end connecting the pulling rod 45 through the ball stud 46. The other end of the pulling rod 45 can be rotationally engaged with rotating shaft 411 of fuel governor arm 41. More specifically, the rotating shaft has one end fixed on fuel governor arm 41 and the other movably disposed in slot 451 of pulling rod 45.

The ball stud 46 has its ball head 47 movably disposed in groove 48 of rocker-arm 44 and the other end fixed on pulling rod 45. The groove may be open as in the FIG. 4 or sealed on both ends.

FIG. 4 shows that spring 42 is a compressed spring which is twisted around pulling rod 45 with one end against the crankcase cover 7 (as the position 73 showed in the FIG. 3) and the other end can bias flange 452 of the pulling rod 45. The pulling rod 45 can bias to a side by spring 42, thus the feed ports of the injection pumps 12 and 22 can be maintained in their closed and/or lowest fuel pumping and/or transmission position, which can prevent fuel use, economize on fuel use, and/or prevent excess engine speed during idling.

The pulling rod 45 is accommodated in a locating sleeve 49 to prevent its lateral motion and limit its movement along the direction of locating sleeve 49. The pulling rod 45 also has a stop structure to prevent it from rotating. As shown in FIG. 4, pulling rod 45 has a semicircle flat 453. Accordingly, locating sleeve 49 has a semicircle hole 491 which engaged with semicircle flat 453. The semicircle 453 of pulling rod 45 can be inserted into semicircle hole 491 and is movable back and forth with a limited travel. Similarly, other structures such as stopper bolt (not shown in the figures) can be disposed to limit and control the rotation and travel of pulling rod 4.

The fuel controlling process of the feed ports of the V-type water-cooled diesel engine will become apparent by consideration of the following description and accompanying drawings.

When the diesel engine is not in operation, the feed ports of the injection pumps 12 and 22 are biased in the fuel cutoff direction.

The electronic governor sends a signal to the sensor 54 to start the control unit 51 when the flywheel 32 and the crankshaft 3 are turned by a starting motor (not shown in figures). Then motor shaft 52 of stepper motor 53 is turned to rotate rocker-arm 44 to be engaged with motor shaft 52. Thus, ball stud 45 in groove 48 is turned and transfers the force to the pulling rod 45 thereon. The pulling rod 45 can overcome the elasticity force of spring 42 and move along the direction of locating sleeve. The pulling rod 45 can move the feed ports that connect the branch arms of the fuel governor arm 41 and counterclockwise rotate around the center of the injection pumps 12 and 22 after moving the fuel governor arm 41 until the diesel engine turns into idle speed condition. The control unit 51 can make the diesel engine working in the variable condition through the feed ports pedals and corresponding potentiometer signal.

The description above is used in an exemplary sense, for example, the feed ports increase can be set clockwise and the decrease can be set count clockwise.

As for the structures in the embodiments of the V-type water-cooled diesel engine, injection pumps 12 and 22 and electrical governor 5 can be disposed on the same crankcase cover 7, thereby compacting the crankcase cover 7.

Furthermore, fuel from both injection pumps 12 and 22 can be controlled by one same fuel governor mechanism of electrical governor 5.

In addition, feed ports of injection pumps 12 and 22 can remain in the closed and/or idle position because of spring 42, thereby ensuring a safe system.

Certain exemplary embodiments also can be applicable for a V-type water-cooled diesel engine which has more than two cylinders.

Certain exemplary embodiments can provide a V-type water-cooled diesel engine that can have a simple and compact structure and can be applicable for powering equipment such as a small portable generator, tractor, mower, water pump, and/or oil pump.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

- there is no requirement for the inclusion of any particular described or illustrated characteristic, function, activity, or element, any particular sequence of activities, or any particular interrelationship of elements;
- any elements can be integrated, segregated, and/or duplicated;
- any activity can be repeated, any activity can be performed by multiple entities, and/or any activity can be performed in multiple jurisdictions; and
- any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope.

Any information in any material (e.g., a United States patent, United States patent application, book, article, etc.)

that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive.

What is claimed is:

1. A V-type water-cooled diesel engine comprising:

a first cylinder and a second cylinder disposed in a V-shape;

a plurality of injection pumps adapted to serve each respective cylinder; and a fuel governor adapted to control fuel from the injection pumps, said fuel governor disposed between said cylinders;

wherein said governor is an electrical governor disposed outside a crankcase that is located between the cylinders, and said plurality of injection pumps are mounted on a cover of said crankcase.

2. A V-type water-cooled diesel engine according to claim 1, wherein:

said plurality of injection pumps are controlled by one fuel governor mechanism, and said electrical governor controls a flow of fuel from the injection pumps of said first cylinder and said second cylinder via said fuel governor mechanism.

3. A V-type water-cooled diesel engine according to the claim 2, wherein:

said fuel governor mechanism comprises a fuel governor arm that connects with feed ports of said injection pumps.

4. A V-type water-cooled diesel engine according to claim 2, wherein:

said fuel governor mechanism further comprises a spring adapted to bias the feed ports to lessen fuel flow.

5. A V-type water-cooled diesel engine according to claim 4, wherein:

said fuel governor mechanism further comprises a governor unit connecting with said spring, said governor unit having a first end connecting a motor shaft of said electrical governor and a second end connecting to said fuel governor arm.

6. A V-type water-cooled diesel engine according to the claim 5, wherein:

said governor unit comprises a rocker-arm having a first end adapted to fix said motor shaft, a pulling rod, and a ball stud, and having a second end that is rotatably connected with a first end of said pulling rod by said ball stud, a second end of said pulling rod rotatably connected with said fuel governor arm.

7. A V-type water-cooled diesel engine according to the claim 6, wherein:

said ball stud having a first end comprising a ball head that is movable in a groove of said rocker-arm and having a second end that is fixed on said pulling rod.

8. A V-type water-cooled diesel engine according to the claim 7, wherein:

said groove is open.

9. A V-type water-cooled diesel engine according to the claim 6, wherein:

said spring applies bias on the pulling rod which urges said feed ports to lessen fuel flow.

10. A V-type water-cooled diesel engine according to the claim 6, wherein:

said pulling rod can be provided in a locating sleeve and has a stop structure which preventing the pulling rod from rotating and limiting its travel.

* * * * *